US005916473A

United States Patent [19]

Kerin

[11] Patent Number: 5,916,473

[45] Date of Patent: Jun. 29, 1999

[54] STEEL POURING NOZZLE

[76] Inventor: Joseph J. Kerin, 5713 Main St., Duluth, Minn. 55807

[21] Appl. No.: 08/868,372

[22] Filed: Jun. 3, 1997

[51] Int. Cl.[6] ..... B22D 41/08

[52] U.S. Cl. ..... 222/601; 222/597

[58] Field of Search ..... 222/601, 597, 222/598, 591; 164/335, 437; 266/236

[56] References Cited

U.S. PATENT DOCUMENTS

| | | | |
|---|---|---|---|
| 2,863,189 | 12/1958 | Beck | 222/601 |
| 3,554,489 | 1/1971 | Kilgore | 251/356 |
| 3,627,180 | 12/1971 | Montgomery | 222/505 |
| 3,735,906 | 5/1973 | Zettlemoyer et al. | 222/567 |
| 3,785,540 | 1/1974 | Donnithore et al. | 222/601 |
| 3,968,908 | 7/1976 | Nelson et al. | 266/272 |
| 4,313,975 | 2/1982 | Mairy | 427/236 |
| 4,541,553 | 9/1985 | McQuillen, Jr. | 222/600 |
| 4,596,345 | 6/1986 | Beckers | 222/600 |
| 4,785,979 | 11/1988 | Svoboda et al. | 222/591 |
| 4,991,753 | 2/1991 | Inubushi et al. | 222/598 |
| 5,335,896 | 8/1994 | Idstein et al. | 266/236 |

*Primary Examiner*—Scott Kastler
*Attorney, Agent, or Firm*—Faegre & Benson LLP

[57] ABSTRACT

A nozzle for a steel pouring ladle having upper and lower nozzle portions and a stopper rod attached to a lower nozzle portion. The upper nozzle portion includes an upper nozzle housing and an upper nozzle core positioned within the upper nozzle housing, the upper nozzle core having a bore therethrough. The lower nozzle portion includes a lower nozzle housing and a lower nozzle core positioned within the housing, the lower nozzle core having a flow chamber. A retaining ring secures the lower nozzle core to the lower nozzle housing. A stopper rod is positioned within the bore of the upper nozzle core and is threadedly attached to the lower nozzle core. The stopper rod selectively engages the upper nozzle core at an upper tapered surface of the bore to form a liquid tight seal and to control the flow of molten metal through the nozzle. By moving the lower nozzle housing and the lower nozzle core in an upward direction, the stopper rod is unseated from the tapered surface of the upper nozzle core, allowing the flow of molten metal through the bore in the upper nozzle core into and through the flow chamber of the lower nozzle core, for delivery to a casting dish or mold.

14 Claims, 5 Drawing Sheets

STEEL POURING NOZZLE

BACKGROUND OF THE INVENTION

1. Field of the Invention

The present invention relates to discharge nozzles used in pouring ladles for controlling the flow of molten metal from the ladle.

2. Description of Related Art

In the steel industry, molten steel was traditionally dispensed from a large vat-like ladle. The ladle was traditionally equipped with a nozzle at a bottom location thereof which controlled the flow of molten steel out of the ladle. Conventional nozzles included a bore through which the molten steel flowed, and a stopper rod assembly that was used to restrict the flow of molten steel through the nozzle. The stopper rod assembly typically had a vertical rod that was covered with a refractory material and that extended upward through the interior of the ladle. A mechanical linkage that was attached to the top portion of the rod was used to raise and lower the stopper rod. The bottom end of the stopper rod was adapted to engage the bore in the nozzle as the stopper rod was lowered, thus restricting the flow of metal through the nozzle. The flow of steel through the nozzle was initiated by actuating the mechanical linkage to lift the stopper rod out of engagement with the bore in the nozzle, thus permitting the molten steel to flow.

It was found to be difficult, however, to precisely control the flow of molten steel in ladles having nozzles and stopper rod assemblies as described above. The stopper rod extended through the interior of the ladle between a linkage at the top of the ladle to the nozzle at the bottom of the ladle, and thus was very long. Because of the length of the stopper rod, it was found to be difficult to open and close the valve with precise control. In addition, because the stopper rod extended throughout the interior of the ladle, and was surrounded by molten steel, it was subject to rapid erosion.

There is therefore a continuing need for improved ladle nozzles. In particular, a nozzle that is efficient to manufacture, has fewer parts, and is more controllable is desirable. In addition, a nozzle having interchangeable components to accommodate different flow rates and that is more resistant to erosion is also desirable.

SUMMARY OF THE INVENTION

The present invention is a discharge nozzle for regulating the flow of molten metal from a pouring ladle that includes a lift device. The discharge nozzle includes a lower nozzle portion and an upper nozzle portion, the upper nozzle portion being attached to the ladle. The upper nozzle portion has an output end with a hollow bore extending to an input end in fluid communication with an interior chamber of the pouring ladle. The lower nozzle portion has a flow chamber in fluid communication with the output end of the bore in the upper nozzle portion. The nozzle further includes an elongated rod having a first end secured to the lower nozzle portion and second end selectively engageable with the input end of the bore of the upper nozzle portion to block the flow of metal through the nozzle.

In one embodiment, the upper nozzle portion further includes an upper nozzle core and an upper nozzle housing, the upper nozzle housing being secured to the ladle. The upper nozzle housing has a hollow passage therethrough, with the upper nozzle core positioned therein. The lower nozzle portion further includes a lower nozzle housing and a lower nozzle core. The lower nozzle housing has a core receiving chamber, and the lower nozzle core is positioned within the core receiving chamber. A retaining ring engages the lower nozzle housing and the lower nozzle core to secure the lower nozzle core within the lower nozzle housing. The elongated rod includes a lower base end, a shaft, and an upper spherical end. The shaft is positioned within the bore of the upper nozzle portion, and the upper spherical end selectively engages the input end of the upper nozzle portion bore as the lift arm is actuated. The lower base end is secured to the lower nozzle core.

DETAILED DESCRIPTION

Figure 1:
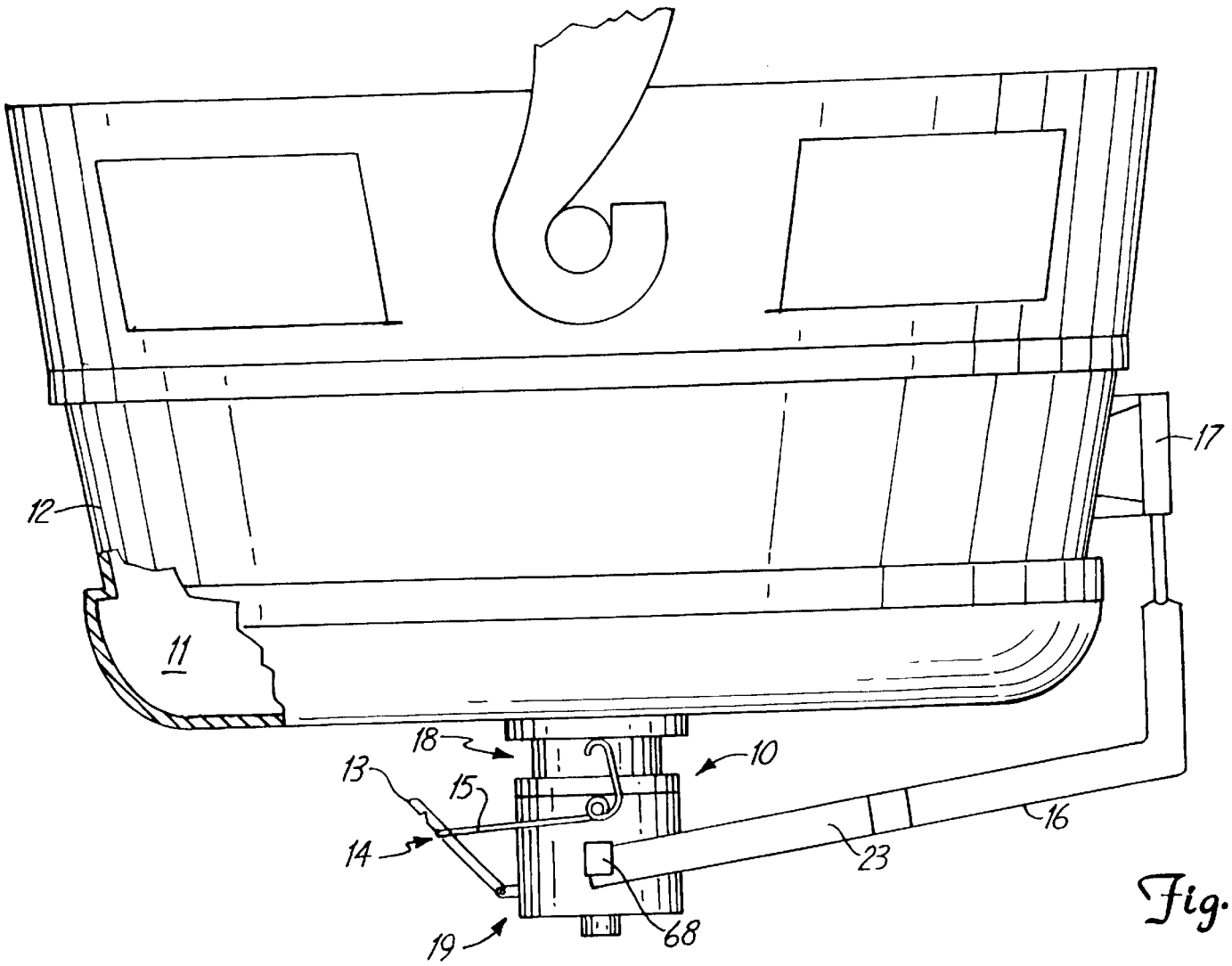
FIG. 1 is a side elevation view of a steel pouring ladle having a nozzle in accordance with the present invention.
Figure 2:
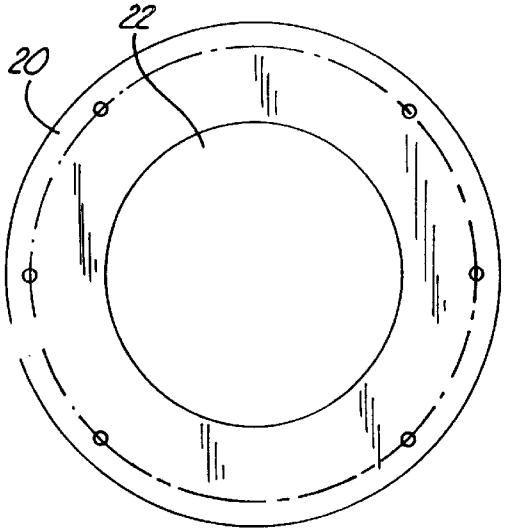
FIG. 2 is a top plan view of the upper nozzle housing of the nozzle of FIG. 1.
Figure 3:
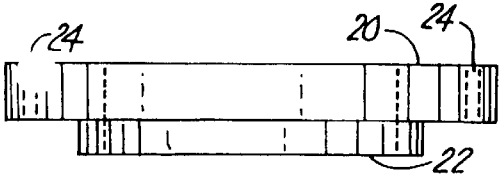
FIG. 3 is a side elevation view of the upper nozzle housing of FIG. 2.
Figure 4:
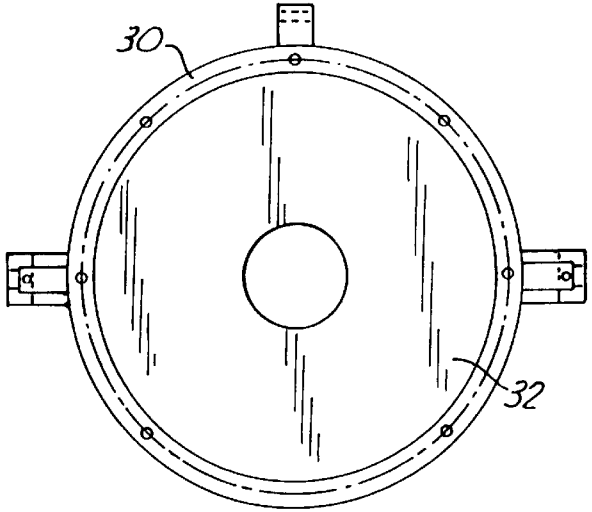
FIG. 4 is a top plan view of the lower nozzle housing of the nozzle of FIG. 1.
Figure 5:
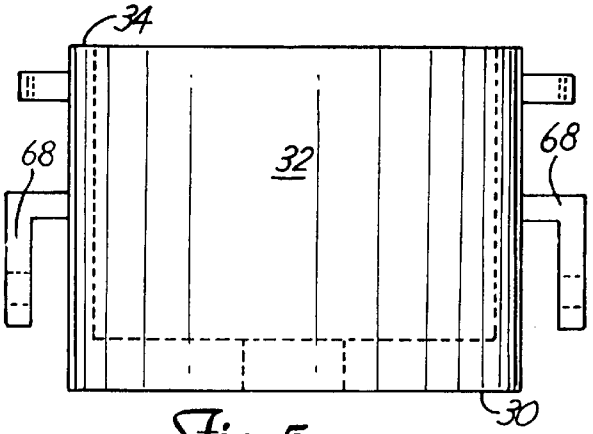
FIG. 5 is a side elevation view of the lower nozzle housing of FIG. 4.
Figure 6:
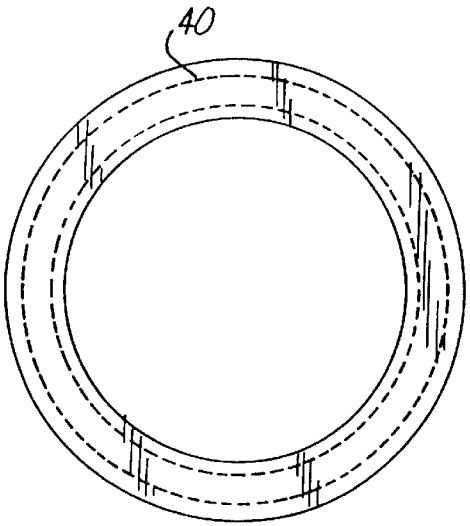
FIG. 6 is a top plan view of the retainer ring of the nozzle of FIG. 1.
Figure 7:
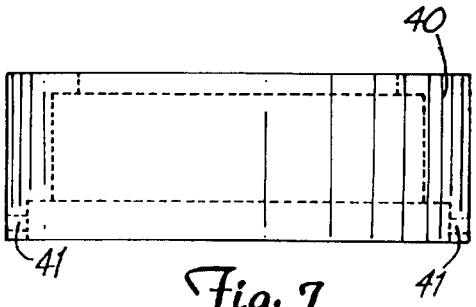
FIG. 7 is a side elevation view of the retainer ring of FIG. 6.
Figure 12:
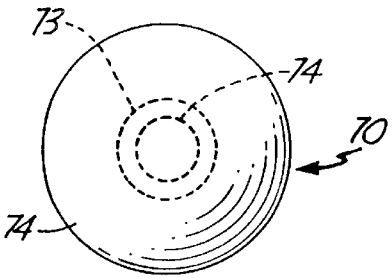
FIG. 12 is a top plan view of a stopper rod useful in the present invention.
Figure 13:
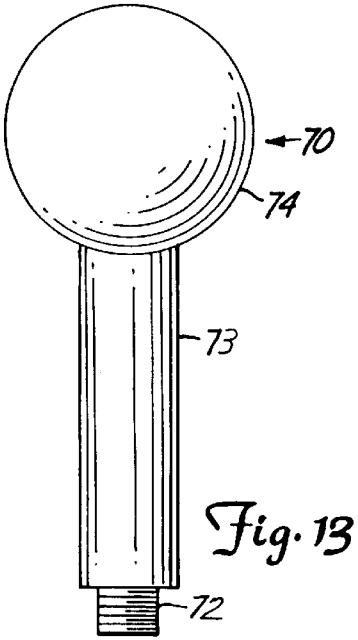
FIG. 13 is a side elevation view of the stopper rod of FIG. 12.
Figure 10:
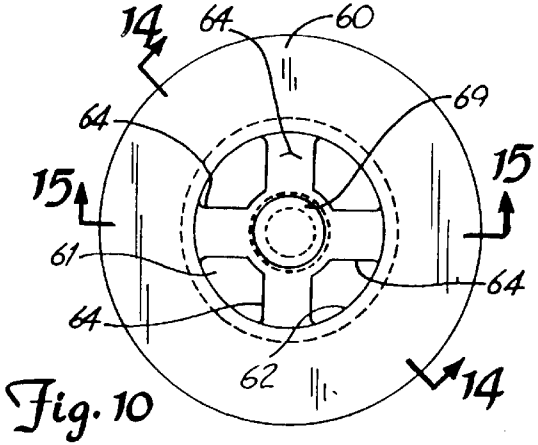
FIG. 10 is a top plan view of the lower nozzle core of the nozzle of FIG. 1.
Figure 11:
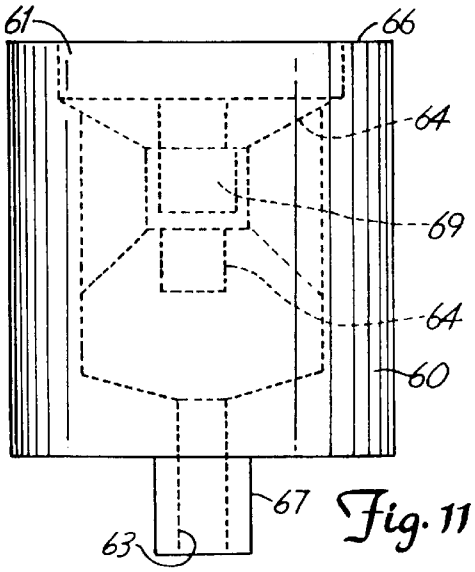
FIG. 11 is a side elevation view of the lower nozzle core of FIG. 10.
Figure 8:
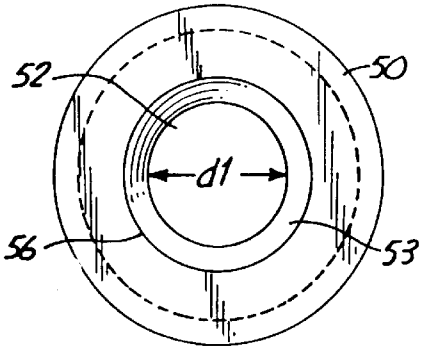
FIG. 8 is a top plan view of the upper nozzle core of the nozzle of FIG. 1.
Figure 9:
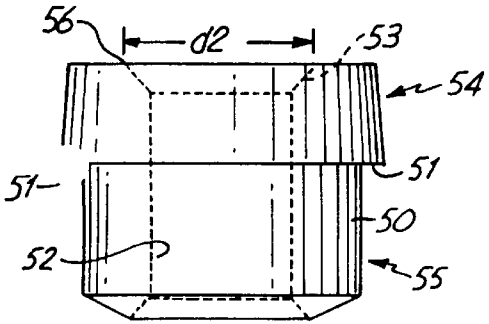
FIG. 9 is a side elevation view of the upper nozzle core of FIG. 8.

The present invention is a replaceable steel pouring nozzle for controlling the flow of molten metal through a pouring ladle. Referring to the Figures, and most particularly to FIGS. 1, 14, and 15, a steel pouring ladle 12 having a nozzle 10 positioned at the bottom of ladle 12 for selectively controlling the flow of molten metal out of the ladle 12 may be seen. Nozzle 10 preferably includes an upper nozzle portion 18, a lower nozzle portion 19, and a stopper rod 70. The upper nozzle portion 18 includes a bore 52 that is in fluid communication with an interior 11 of ladle 12, and lower nozzle portion 19 includes a flow chamber 61 in fluid communication with the bore in the upper nozzle portion 18. As described in greater detail below, molten metal flows from ladle 12 through the bore 52 in upper nozzle portion 18 and through the flow chamber 61 of the lower nozzle portion 19.

Figure 16:
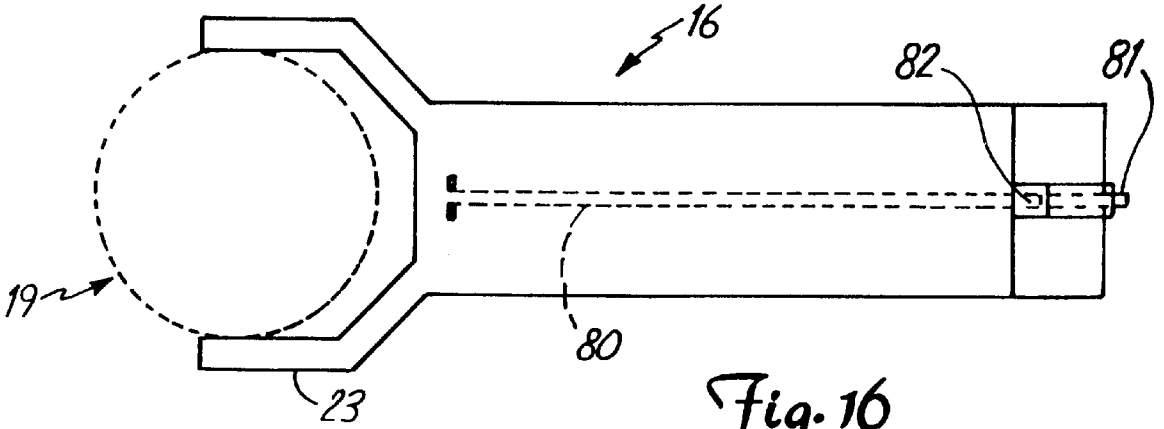
FIG. 16 is a top plan view of a lift arm useful in the present invention.
Figure 17:
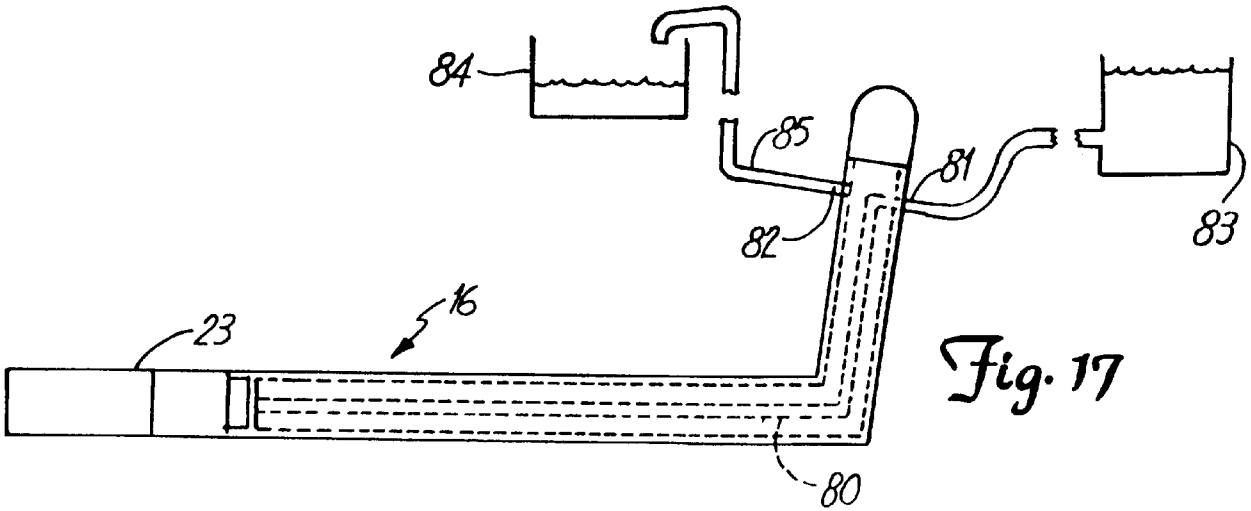
FIG. 17 is a side elevational view of the lift arm of FIG. 16.

Flow is initiated through nozzle 10 by the upward movement of the lower nozzle portion 19, preferably using a lifting arm 16 that is attached to lower nozzle portion 19. In the embodiment shown in FIGS. 1, 16, and 17, lift arm 16 is rigid along its entire length, and includes a fork or a yoke 23 that is connected to opposite sides of lower nozzle portion 19. Lift arm 16 is actuated with a pneumatic cylinder 17 to vertically move lower nozzle portion 19. Due to the heat generated by the molten metal in ladle 12, lift arm 16 is cooled with an external fluid, such as water, that circulates within a passage, such as tube 80, in lift arm 16. An inlet end 81 of tube 80 in lift arm 16 is attached to an external, driven fluid source such as water tank 83, and an outlet end 82 of tube 80 in lift arm 16 is attached to an output hose 85 which drains to a tank 84. In this manner, fluid circulates through tube 80 to cool the lift arm 16. Those skilled in the art will recognize, however, that other lifting mechanisms can be used without departing from the spirit and scope of the present invention.

A locking mechanism 14 is attached to nozzle 10. Locking mechanism 14 includes lock arm 13 attached to lower nozzle portion 19 and lock rod 15 securely attached to upper nozzle portion 18. Lock arm 13 engages rod 15 to inhibit the vertical motion of lower nozzle portion 19. In this manner, locking mechanism 14 prevents an unwanted or accidental discharge of molten metal through nozzle 10. Other locking mechanisms can also be used without departing from the spirit and scope of the present invention.

Referring now to FIGS. 2–13, various components of one embodiment of nozzle 10 may be seen. The upper nozzle portion 18 includes an annular upper nozzle housing 20 and a stepped cylindrical upper nozzle core 50. The lower nozzle portion 19 includes a generally cylindrical lower nozzle housing 30, a lower nozzle core 60, and an annular retainer ring 40. Stopper rod 70 preferably has a first end, shown as threaded lower base end 72, connected by a shaft 73 to a second enlarged end, shown as upper spherical end 74.

Upper nozzle core 50 includes an upper portion 54, a shoulder 51, and a lower portion 55. Upper portion 54 of upper nozzle core 50 is inserted within an opening at the bottom of ladle 12, and upper portion 54 can be tapered to facilitate the insertion of the upper nozzle core 50 into ladle 12. Upper nozzle housing 20 includes a bore 22 into which lower portion 55 of upper nozzle core 50 is inserted. Upper nozzle housing 20 is then removably attached to the bottom of ladle 12 with conventional fasteners, such as bolts (not shown) received through apertures 24. Shoulder 51 of upper nozzle core 50 engages an upper surface 21 of upper nozzle housing 20, and in this manner, upper nozzle housing 20 holds upper nozzle core 50 in place in nozzle 10. Shoulder 51 of upper nozzle core 50 can be coated with a sealant material, such as Helspot or other forms of ganistar, prior to insertion of upper nozzle core 51 into ladle 12 to provide a seal between the upper nozzle core 50 and the upper nozzle housing 20.

Upper nozzle core 50 further includes a generally cylindrical bore 52 extending through upper nozzle core 50. Bore 52 has a first diameter d1 that is substantially constant along the length of the bore. Bore 52 extends to a preferably spherical chamfer 56 in upper nozzle core 50 having a second diameter d2 at the upper portion of bore 52 greater than the first diameter d1. An upper seat 53 is thus formed between the first diameter d1 and second diameter d2 portions of bore 52.

Figure 15:
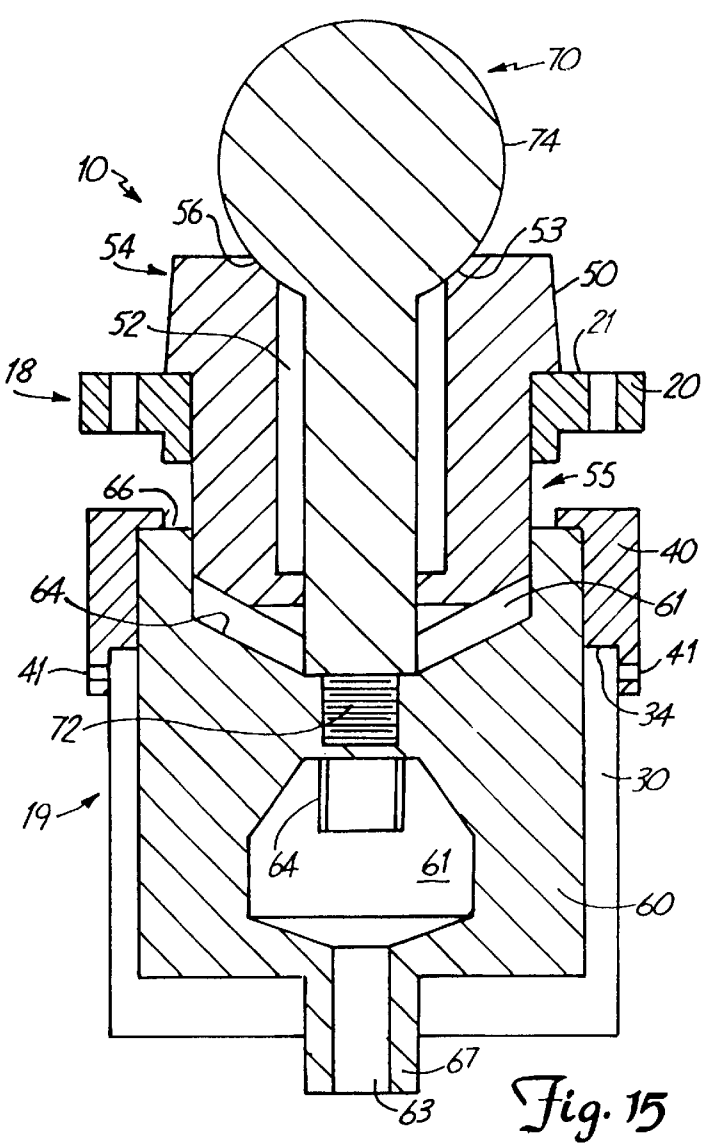
FIG. 15 is a view similar to that of FIG. 14 except with the stopper rod in a second position in sealing engagement with the upper nozzle core to prevent the flow of molten metal through the nozzle.
Figure 14:
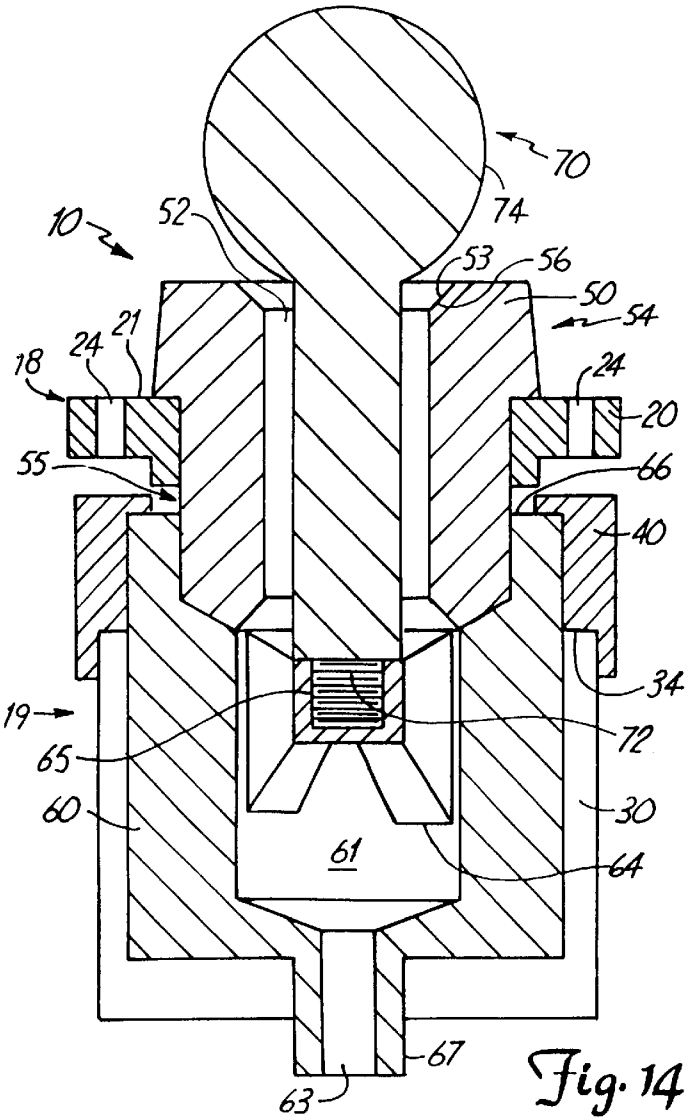
FIG. 14 is a side elevation view in section of the nozzle of the present invention showing the stopper rod in a first position spaced apart from the upper nozzle core to permit the flow of molten metal through the nozzle.

Lower nozzle housing 30 has a generally cylindrical chamber 32 sized to receive lower nozzle core 60. Lower nozzle core 60 is placed within chamber 32, and is held in place within lower nozzle housing 30 by retaining ring 40. As best seen in FIGS. 14 and 15, retaining ring 40 engages atop surface 34 of the lower nozzle housing 30 and a top surface 66 of the lower nozzle core 60 to hold core 60 securely within lower nozzle housing 30. Retaining ring 40 is secured to lower nozzle housing 30 with conventional fasteners, such as bolts (not shown) which are received within apertures 41 in retaining ring 40, and which engage lower nozzle housing 30. Lower nozzle housing 30 includes engagement members 68 on the outer side surfaces of lower nozzle housing 30 to accommodate lifting arm 16.

Lower nozzle core 60 includes a flow chamber 61 through which molten metal may flow. Flow chamber 61 includes an input end 62 in fluid communication with bore 52 of the upper nozzle core 50 and a discharge end 63 in a projection 67 that extends through chamber 32 of the lower nozzle housing 30. Lower nozzle core 60 includes gussets 64 for providing strength to the nozzle, and for providing an area larger than the diameter d1 of bore 52 to eliminate back pressure when pouring molten metal into a mold or casting machine dish positioned beneath discharge end 63 of flow chamber 61 of lower nozzle core 60.

Shaft 73 of stopper rod 70 passes through bore 52 of upper nozzle core 50. Lower nozzle core 60 includes means to securely engage lower base end 72 of stopper rod 70, such as threads 65 in blind bore 69 supported by gussets 64 as shown in FIGS. 14 and 15. Spherical upper end 74 of stopper rod 70 selectively engages upper seat 53 of upper nozzle core 50 to form a molten-metal-tight seal to prevent the flow of molten metal through nozzle 10. Upper seat 53 is preferably concave to better conform to spherical upper end 74, thus creating a more effective seal.

As shown in greatest detail in FIGS. 14 and 15, upward movement of lower nozzle housing 30 (and corresponding movement of retaining ring 40 and lower nozzle core 60) is used to initiate the flow of molten metal through nozzle 10. As shown in FIG. 14, an upward motion of the lower nozzle housing 30 will move lower nozzle core 60 and stopper rod 70 in an upward direction to a first position where the upper spherical end 74 of stopper rod 70 is spaced apart from upper nozzle core 50, thus unseating the spherical end 74 of stopper rod 70 from the upper seat 53 of upper nozzle core 50. Molten metal will then be permitted to flow (as, for example, under the force of gravity) past spherical end 74 of stopper rod 70 into bore 52, and then into flow chamber 61 of lower nozzle core 60. From there, the metal may flow out discharge end 63 of flow chamber 61 in a manner suitable for delivery to a mold or casting machine dish (not shown) positioned beneath the nozzle 10. The flow of molten metal is stopped by moving lower nozzle housing 30 and lower nozzle core 60 in the downward direction to a second position shown in FIG. 15. By moving the lower nozzle housing 30 and lower nozzle core 60 in a downward direction, spherical end 74 of stopper rod 70 engages upper seat 53 of upper nozzle core 50. In this manner, stopper rod 70 and seat 53 create molten-metal-tight seal, and the flow of molten metal through the nozzle 10 is thus stopped.

Due to conventional thermodynamic properties, nozzle 10 generally has a lower temperature than the molten metal in ladle 12. When stopper rod 70 is moved to the position shown in FIG. 14, and the molten metal flows past the stopper rod 70 and through bore 52 and chamber 61 of the nozzle 10, the lower temperature of these nozzle components may cause molten metal to solidify and adhere to the cooler surfaces of the components. This is particularly problematic for the stopper rod 70, since build-up of metal on rod 70, especially spherical end 74, may interfere with the proper functioning of nozzle 10. For this reason, a non-wetting or lubricating coating is preferably applied to stopper rod 70 to minimize this solidification of molten metal to the rod surfaces, thus allowing spherical end 74 to sealingly engage seat 53 and allowing stopper rod 70 to freely move. The non-wetting or lubricating coating material is preferably comprised of finely divided non-wetting or lubricating refractory material and a binder, as is well known in the art. The consistency of the coating material should be such that it can be applied by dipping, and is preferably formed in situ on stopper rod 70.

A pouring nozzle in accordance with the present invention has many advantages over prior art nozzles. Because the motion of the stopper rod 70 is controlled at the lower nozzle housing 30 of nozzle 10, a more precise starting and stopping action for the flow of molten metal can be achieved due to the reduced moment arm acting on stopper rod 70. In addition, because stopper rod 70 does not extend throughout the height of the interior of ladle 12, stopper rod 70 will be subject to less erosion over time, thereby making the operation of ladle 12 and nozzle 10 more efficient. Furthermore, because of the two-piece design and the use of removable retainer ring 40, the components of nozzle 10 may easily be removed to accommodate replacement parts and to allow the use of various sizes of nozzles to adjust the flow of molten metal through the nozzle.

The invention is not to be taken as limited to all of the details thereof as modifications and variations thereof may be without departing from the spirit or scope of the invention. For example, upper seat 53 of upper nozzle core 50 and the enlarged second end of stopper rod 70 that engages upper seat 53 may be other than spherical in shape, provided that they form a liquid tight seal when resting against each other in a closed position.

What is claimed is:

1. A discharge nozzle for regulating the flow of molten metal from a pouring ladle having an outer surface and an interior chamber that includes a lift device, the discharge nozzle comprising:

an upper nozzle portion attached to the outer surface of ladle, the upper nozzle portion having a hollow bore therethrough with an input end in fluid communication with the interior chamber of the pouring ladle and an output end;

a lower nozzle portion having a flow chamber in fluid communication with the output end of the bore in the upper nozzle portion, the lower nozzle portion attached to the lift device of the ladle; and an elongated rod having a first end secured to the lower nozzle portion and an enlarged second end that engages the input end of the bore of the upper nozzle portion in a first position to block the flow of metal through the nozzle, and is selectively moveable with the lower nozzle portion to a second position spaced apart from the input end to allow a flow of molten metal through the nozzle as the lift device raises the lower nozzle portion of the nozzle.

2. The discharge nozzle of claim 1 wherein the upper nozzle portion further includes:

an upper nozzle housing secured to the ladle, the upper nozzle housing having a hollow passage therethrough, and an upper nozzle core positioned within the hollow passage of the upper nozzle housing, the upper nozzle core including the bore of the upper nozzle portion.

3. The discharge nozzle of claim 1 wherein the lower nozzle portion further includes:

a lower nozzle housing having a core receiving chamber; and a lower nozzle core positioned within the core receiving chamber of the lower nozzle housing, the lower nozzle core including the flow chamber of the lower nozzle portion.

4. The discharge nozzle of claim 3, the lower nozzle further including a retaining ring that engages the lower nozzle housing and the lower nozzle core to secure the lower nozzle core within the lower nozzle housing.

5. The discharge nozzle of claim 1 wherein the enlarged second end of the stopper rod is generally spherical.

6. The discharge nozzle of claim 1 wherein the stopper rod includes a shaft between the first end and the enlarged second end, the shaft being positioned within the bore in the upper nozzle portion of the nozzle.

7. The discharge nozzle of claim 2 wherein the bore in the upper nozzle core is substantially cylindrical and has a first diameter that is substantially constant along a portion of the bore.

8. The discharge nozzle of claim 7 wherein the input end of the bore in the upper nozzle core further comprises a chamfer substantially having a second diameter that is greater than the first diameter.

9. The discharge nozzle of claim 8 wherein the bore in the upper nozzle core includes an upper beveled surface that extends between the first and second diameter portions of the upper nozzle core.

10. The discharge nozzle of claim 9 wherein the upper beveled surface is concave, and the enlarged second end of the elongated rod engages the concave upper beveled surface of the bore in the upper nozzle core to block the flow of metal through the nozzle when the lower nozzle portion is in the first position.

11. The discharge nozzle of claim 1 wherein the elongated rod has a coating of non-wetting material to inhibit the adhesion of molten metal on the rod as the molten metal passes through the nozzle.

12. A discharge nozzle for regulating the flow of molten metal from a pouring ladle, the discharge nozzle comprising:

an upper housing attached to the pouring ladle;

an upper nozzle core positioned within the upper nozzle housing;

an upper bore that passes through the upper nozzle core, the bore having an input end with a tapered surface in fluid communication with an interior of the ladle and an output end;

a lower housing having one or more engagement members;

a lift arm attached to the one or more engagement members of the lower housing;

a lower nozzle core positioned and secured within the lower housing by a retaining ring;

a lower flow chamber within the lower nozzle core, the lower flow chamber having an input end in fluid communication with the output end of the upper bore and a discharge end; and an elongated rod having a base end removably secured to the lower nozzle core, a shaft extending from the base end and positioned within the upper bore, and a spherical upper end on the shaft and engageable with the tapered surface of the input end of the upper bore to selectively permit a flow of molten metal through the upper bore, the elongated rod being coated with a lubricating material for inhibiting the adhesion of molten metal on the elongated rod.

13. The discharge nozzle of claim 12 wherein the lift arm further includes a passage having an inlet end and an outlet end, wherein the inlet end is attached to an external fluid source and the outlet end is attached to a reservoir for circulating fluid through the passage to cool the lift arm.

14. A method of manufacturing a pouring ladle and a discharge nozzle for regulating the flow of molten metal from the pouring ladle, the method comprising the steps of:

providing a pouring ladle having an outer surface and an interior;

providing an upper nozzle portion having a bore therethrough, the bore including an input end and an output end;

providing a lower nozzle portion having a flow chamber therethrough and rod receiving means;

providing an elongated rod having a first end, a second end, and a shaft between the first and second ends;

positioning the shaft of the elongated rod within the bore of the upper nozzle portion;

attaching the first end of the elongated rod to the rod receiving means of the lower nozzle portion so that the second end of the elongated rod selectively engages the input end of the bore in the upper nozzle portion to block a flow of metal through the nozzle; and attaching the upper nozzle portion to the outer surface of the ladle so that the input end of the bore in the upper nozzle is in fluid communication with the interior of the ladle.

* * * * *